US008482210B2

(12) United States Patent
He et al.

(10) Patent No.: US 8,482,210 B2
(45) Date of Patent: Jul. 9, 2013

(54) LUMINANCE ADJUSTING CIRCUIT

(75) Inventors: Zu-Pei He, Shenzhen (CN); Ruey-Shyang You, New Taipei (TW); Han-Che Wang, New Taipei (TW); Kuan-Hong Hsieh, New Taipei (TW)

(73) Assignee: Hong Fu Jin Precision Industry (ShenZhen) Co., Ltd., Shenzhen (CN)

( * ) Notice: Subject to any disclaimer, the term of this patent is extended or adjusted under 35 U.S.C. 154(b) by 86 days.

(21) Appl. No.: 13/308,565

(22) Filed: Dec. 1, 2011

(65) Prior Publication Data

US 2013/0106302 A1 May 2, 2013

(30) Foreign Application Priority Data

Oct. 26, 2011 (CN) ..... 2011 1 0329507

(51) Int. Cl.
*H05B 37/02* (2006.01)

(52) U.S. Cl.
USPC ..... 315/209 R

(58) Field of Classification Search
USPC ..... 315/201, 209 R, 210
See application file for complete search history.

(56) References Cited

U.S. PATENT DOCUMENTS

| | | | | |
|---|---|---|---|---|
| 2008/0224625 | A1* | 9/2008 | Greenfeld | 315/201 |
| 2011/0279040 | A1* | 11/2011 | Briggs et al. | 315/136 |
| 2013/0009561 | A1* | 1/2013 | Briggs | 315/210 |

* cited by examiner

*Primary Examiner* — Thienvu Tran
(74) *Attorney, Agent, or Firm* — Altis Law Group, Inc.

(57) ABSTRACT

A luminance adjusting circuit includes an LED module, a switch module and a processing unit. A table equating luminance levels and average current values is pre-stored. The processing unit includes a judging and executing module and a signal generating module. The judging and executing module achieves a desired luminance level according to trigger signals generated by a button. The signal generating module produces timing signals to turn on and turn off the switch module periodically, thereby achieving an average current value to adjust the luminance level of the LED module to the desired level.

11 Claims, 3 Drawing Sheets

LUMINANCE ADJUSTING CIRCUIT

BACKGROUND

1. Technical Field

The present disclosure relates to a luminance adjusting circuit.

2. Description of the Related Art

Most LED (light emitting diode) driving circuits employ rectifier bridge for converting alternating current (AC) provided by a power supply, into a direct current to power LEDs. An LED module applied in the LED driving circuit includes a number of LEDs. If the voltage across each of the LEDs can not be maintained within a predetermined range, the luminance of each of the LEDs may change. Although some integrated circuits (ICs) can be employed in the LED driving circuit to adjust the luminance of the LEDs, the structure of the IC is complicated, and the price is expensive.

Therefore, there is room for improvement within the art.

BRIEF DESCRIPTION OF THE DRAWINGS

The components in the drawings are not necessarily drawn to scale, the emphasis instead being placed upon clearly illustrating the principles of a luminance adjusting circuit. Moreover, in the drawings, like reference numerals designate corresponding parts throughout the several views.

DETAILED DESCRIPTION

Figure 1:
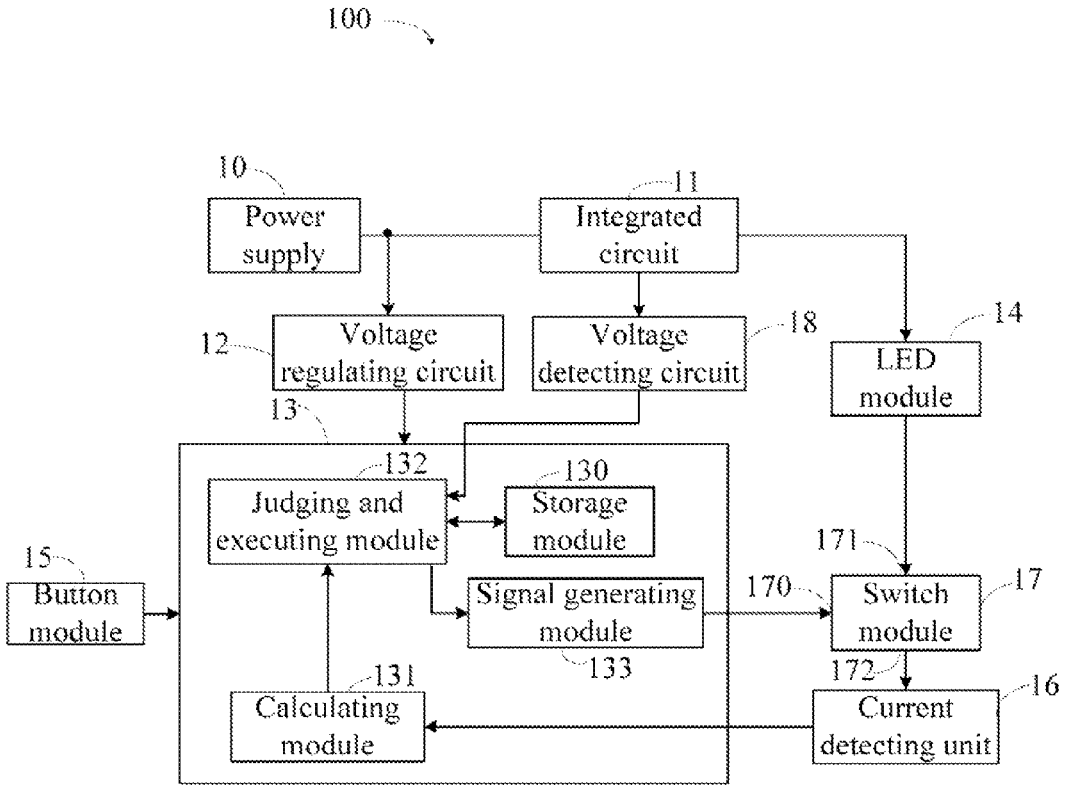
FIG. 1 is a block diagram of a luminance adjusting circuit in accordance with an embodiment.

Referring to FIG. 1, a luminance adjusting circuit 100 includes a power supply 10, an integrated circuit 11, and an LED module 14 incorporating a number of LEDs. The integrated circuit 11 connected between the power supply 10 and the LED module 14 converts the alternating current provided by the power supply 10 into a form of direct current. The direct current flows to the LED module 40 to power the LEDs of the LED module 14.

The luminance adjusting circuit 100 further includes a voltage regulating circuit 12, a processing unit 13, a button module 15, a current detecting unit 16, and a switch module 17. The voltage regulating circuit 12 connected between the power supply 10 and the processing unit 13 is configured for regulating the voltage output from the power supply 10 which is forwarded to the processing unit 13. The switch module 17 includes a control terminal 170, a first conduction terminal 171, and a second conduction terminal 172. The first conduction terminal 172 is connected to the current detecting unit 16, and the second conduction terminal 171 is connected to the LED module 14.

The processing unit 13 includes a storage module 130, a calculating module 131, a judging and executing module 132, and a signal generating module 133. The storage module 130 stores a table defining a relationship between luminance levels of the LED module 14 and average current flowing through the LED module 14. The control terminal 170 is connected to the signal generating module 133. The current detecting unit 16 is connected between the second conduction terminal 172 and the calculating module 131. The button module 15 creates trigger signal(s) in response to the user's operation thereon, and sends the trigger signal(s) to the judging and executing module 132.

The button module 15 may be an electronic button or a mechanical button disposed on an electronic device (not shown) in which the LED luminance adjusting circuit 100 is employed. In the embodiment, the button module 15 is a mechanical button.

The judging and executing module 132 is configured for establishing the luminance level of the LED module 14 according to the table stored in the storage module 130 (as described below), and further produces a luminance adjusting control signal when a trigger signal is received from the button module 15. In the embodiment, the button module 15 generates one trigger signal per touch or per press. In the embodiment, the judging and executing module 132 generates one luminance adjusting control signal to change the luminance of the LED module 14 from a lower level to a higher level, or from a higher level to a lower level, in response to the trigger signal. In an alternative embodiment, the judging and executing module 132 generates one luminance adjusting control signal to change the luminance of the LED module 14 from a higher level to a lower level or from a lower level to a higher level in response to the trigger signal.

The table defines four luminance levels, i.e., the first level to the fourth level, in a sequence of low luminance level to high luminance level, the fourth level being the highest luminance level. If the judging and executing module 132 determines the current luminance level of the LED module 14 is at the second level, when the button module 15 generates two consecutive trigger signals, for example, the judging and executing module 132 generates a signal(s) to change the luminance level of the LED module 14 from the second level to the fourth level. When the button module 15 generates four consecutive trigger signals, the judging and executing module 132 changes the luminance level of the LED module 15 from the second level to the second level in the next turn. Thus the judging and executing module 132 counts the luminance levels from the second level to the fourth level, then cycles down to a first level and counts from the first level to the second level. Thus, the judging and executing module 132 may adjust the luminance level of the LED module 14 according to the number of operations on the button module 15.

The judging and executing module 132 further determines the average current value of the preset luminance levels defined in the table, and generates a signal to control the signal generating module 133 to produce a timing signal to the switch module 17 according to the average value of the current required. The timing signal defines a first control signal and a first endurance time of the first control signal, and a second control signal and a second endurance time of the second control signal, in a manner of a pulse width modulated signal. In the embodiment, the switch module 17 is turned on in response to the first control signal, and turned off in response to the second control signal. Thus, the judging and executing module 132 controls the signal generating module 133 to produce the timing signal to turn on or off the switch module 17 periodically, thereby adjusting the current flowing through the LED module 14 to obtain an average current value which according to the table equates to the desired luminance level.

In the embodiment, the first control signal is a high level signal, and the second control signal is a low level signal. The switch module 17 is turned on when the signal generating module 133 produces the first control signal, and turned off when the signal generating module 133 produces the second control signal.

In the embodiment, the luminance of the LED module 14 is set to be at the first level when the electronic device is switched on.

In the embodiment, if the actual luminance level is not equal to the desired luminance level, the actual luminance level can be adjusted. The manner for adjusting the actual luminance level to the desired luminance level is: detecting the value of the current flowing through the LED module 14 by the current detecting unit 16; calculating the average value of the current in a predetermined period according to the value of the current detected, by the calculating module 131; comparing the average value calculated by the calculating module 131 with the average value of the current for the desired luminance level, as defined in the table. If the average value calculated by the calculating module 131 is not equal to the desired luminance level, the judging and executing module 132 controls the signal generating module 133 to produce the necessary timing signal(s) with the required endurance times of the first and second control signals, and adjusting the luminance level of the LED module 14 to achieve compliance.

The luminance adjusting circuit 100 further includes a voltage detecting unit 18. The voltage detecting unit 18 is connected between the integrated circuit 11 and the judging and executing module 132, and detects the output voltage of the integrated circuit 11. The judging and executing module 132 is further configured for determining whether such output voltage is lower than a preset value, and controlling the signal generating module 133 to produce a signal to turn off the switch module 17 for a longer period when the output voltage is determined to be lower than the preset value. The preset voltage is the minimum working voltage of the LED module 14.

Figure 2:
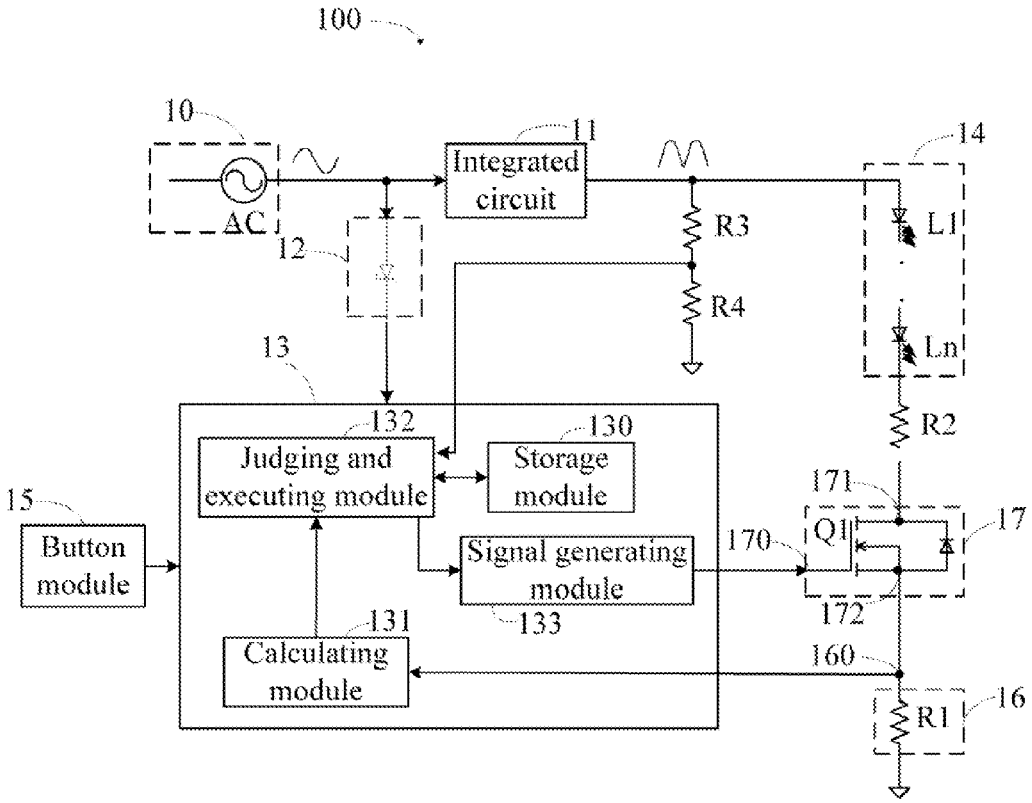
FIG. 2 is a circuit diagram of the luminance adjusting circuit of FIG. 1.

Referring to FIG. 2, the integrated circuit 11 includes a bridge rectifier $D_1$. The bridge rectifier $D_1$ converts a full-wave alternating current in each period provided by the power supply 10 into two half-wave direct current in each period, which may flow to the LED module 14. The LED module 14 includes a number of LEDs, $L_1$-$L_n$, connected in series. All the LEDs are connected to the switch module 17 via a resistor $R_2$.

In the embodiment, the switch module 17 is an N-channel metal oxide semiconductor (NMOS). The gate of the NMOS is connected to the signal generating module 133, the source of the NMOS is connected to the current detecting unit 16, and the drain of the NMOS is connected to the LED module 14 via the resistor $R_2$.

The current detecting unit 16 includes a resistor $R_1$. The resistor $R_1$ and the source terminal of the NMOS are connected to a first intersection 160. The calculating module 131 is connected to the first intersection 160. The voltage regulating circuit 12 includes a zener diode $D_2$.

Figure 3:
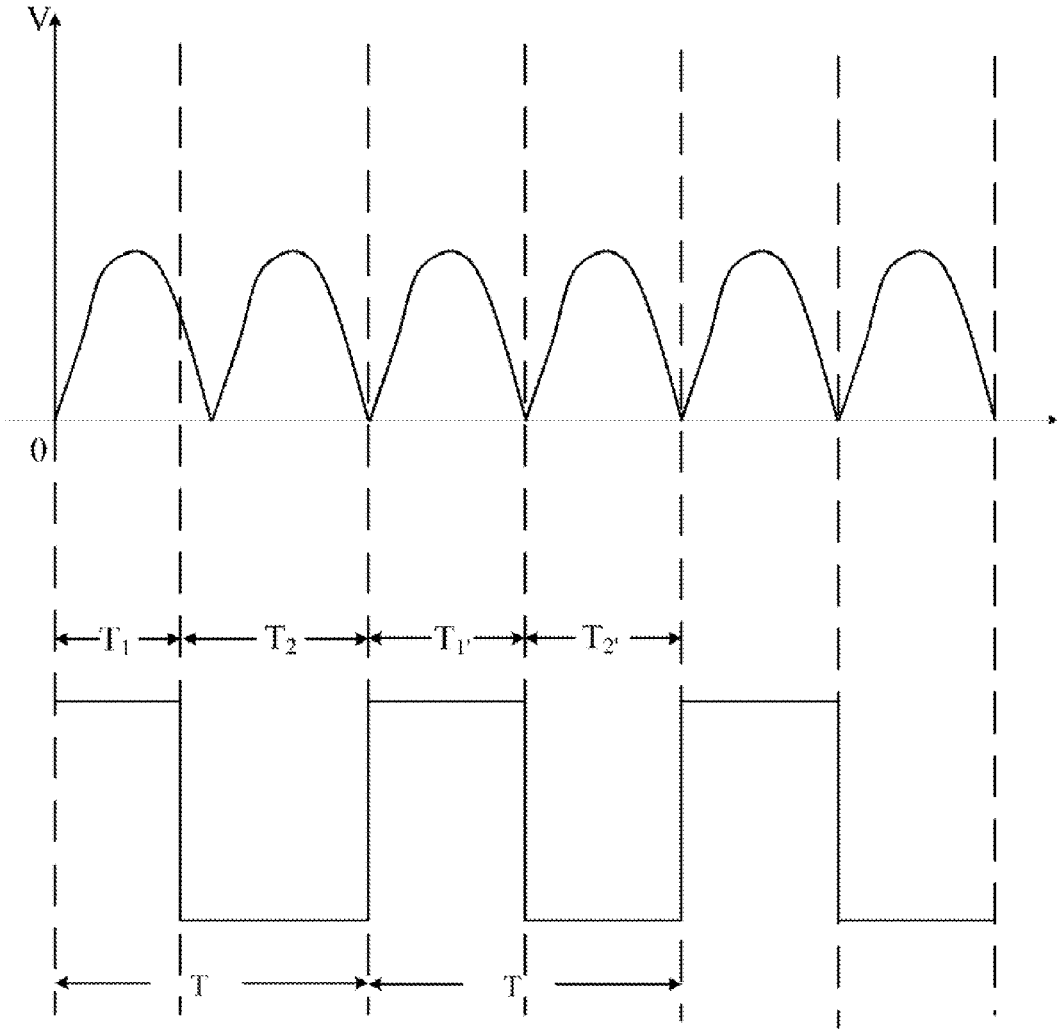
FIG. 3 is a sequence diagram of the luminance adjusting circuit of FIG. 2.

Referring to FIG. 3, in the embodiment, the signal generating module 133 produces a pulse-width modulated (PWM) wave. For example, the luminance level of the LED module 14 is determined to be at the second level. The judging and executing module 132 is controlling the signal generating module 133 to produce the timing signal for period T including a first lasting time $T_1$ and a second lasting time $T_2$, to control the average current value flowing through the LED module 14 to achieve the average current value corresponding to the second level according to the table, thereby maintaining the luminance level of the LED module 14 at the second level.

When the desired luminance level of the LED module 14 is the third level, the judging and executing module 132 controls the signal generating module 133 to produce a timing signal for period T' including a first lasting time $T_1'$ and a second lasting time $T_2'$. In the embodiment, the signal generating module 133 produces a high level signal for turning on the NMOS for the first lasting time $T_1'$ and then producing a low level signal for turning off the NMOS during the second lasting time $T_2'$. The average current flowing through the LED module 14 is fixed at the average current corresponding in the table to the third level, thereby adjusting the luminance level of the LED module 14 from the second level to the third level.

The voltage provided to the LED module 14 is in a form of direct voltage with two half-waves in each period, the value of the current flowing through the LED module 14 changes with the direct voltage of the two half-waves in the first endurance time $T_1'$. The calculating module 133 calculates the average value of the current resulting based on the value of the current detected by the current detecting unit 16 in integral principle during the period T'.

The period of the timing signal, the first lasting time and the second lasting time are short enough to avoid any possibility of flickering which might be visible to a user.

The bridge rectifier $D_1$ is connected to the judging and executing module 132 via a resistor $R_3$. The resistor $R_4$ and the bridge rectifier $D_1$ are connected to a second intersection 110. The judging and executing module 132 determines whether or not the voltage of the second intersection 110 is lower than the preset voltage.

It is understood that the present disclosure may be embodied in other forms without departing from the spirit thereof. The present examples and embodiments are to be considered in all respects as illustrative and not restrictive, and the disclosure is not to be limited to the details given herein.

What is claimed is:

1. A luminance adjusting circuit, comprising:

an integrated circuit configured for converting alternating current provided by a power supply into direct current;

an LED (light emitting diode) module comprising a plurality of LEDs;

a button module configured for creating trigger signals in response to user's operation on the button module;

a switch module connected to the LED module;

a processing unit comprising:

a storage module configured for storing a table defining a relationship between luminance levels of the LED module and average current flowing through the LED module;

a judging and executing module configured for determine a desired luminance level according to the trigger signals, and further determines the average value of the current in the table corresponding to the desired luminance level; and a signal generating module connected to the switch module, and configured for producing a timing signal according to the average value of the current required controlled by the judging and executing module, to turn on or off the switch module periodically for adjusting a current flowing through the LED module to obtain an average current value which according to the table equates to the desired luminance level, thereby adjusting the luminance level of the LED module to the desired the luminance level.

2. The luminance adjusting circuit as recited in claim 1, wherein the judging and executing module determines the luminance level of the LED module from a lower level to a higher level circularly according to the number of the trigger signals.

3. The luminance adjusting circuit as recited in claim 1, wherein the time signal defines a first control signal and a first endurance time of the first control signal, and a second control signal and a second endurance time of the second control signal periodically.

4. The luminance adjusting circuit as recited in claim 3, wherein the switch module is turned on in response to the first control signal, and turned off in response to the second control signal.

5. The luminance adjusting circuit as recited in claim 3, wherein the first control signal is a high level signal, and the second control signal is a low level signal.

6. The luminance adjusting circuit as recited in claim 1, wherein the integrated circuit comprises a bridge rectifier, and configured for converting an alternating current with full-wave in each period provided by the power supply into a direct current with two half-wave in each period which flows to the LED module.

7. The luminance adjusting circuit as recited in claim 1, further comprising:

a current detecting unit connected between the switch module and the processing unit, and configured for detecting the currents flowing through the LED module;

the processing unit further comprising:

a calculating module connected to the current detecting unit, and configured for calculating an average value of the current in a predetermined period according to the currents detected by the current detecting unit;

wherein the judging and executing module further is configured for comparing the average value of the current calculated by the calculating module with the average value of the current defined in the table corresponding to the luminance level of the LED module, and controls the signal generating module to produce the timing signal correspondingly to monitoring and adjusts the luminance level of the LED module.

8. The luminance adjusting circuit as recited in claim 1, further comprising a voltage detecting unit connected between the integrated circuit and the judging and executing module, wherein the voltage detecting unit is configured for detecting the output voltage of the integrated circuit.

9. The luminance adjusting circuit as recited in claim 8, wherein the judging and executing module is further configured for determining whether the output voltage is lower than a preset voltage or not, and controls the signal generating module to produce a signal to turn off the switch module correspondingly when the output voltage is determined to be lower than the preset voltage.

10. The luminance adjusting circuit as recited in claim 9, wherein the preset voltage is a minimum working voltage of the LED module.

11. The luminance adjusting circuit as recited in claim 1, the switch module comprises a control terminal connected to the signal generating module, a first conduction terminal connected to the current detecting unit, and a second conduction terminal connected to the LED module.

* * * * *